United States Patent [19]

Hanna

[11] 4,382,576

[45] May 10, 1983

[54] INGOT MOLD

[76] Inventor: Glenn W. Hanna, 1441 Wightman St., Pittsburgh, Pa. 15217

[21] Appl. No.: 235,152

[22] Filed: Feb. 17, 1981

[51] Int. Cl.[3] ..... B22D 7/06

[52] U.S. Cl. ..... 249/174; 29/402.09; 164/412

[58] Field of Search ..... 249/174, 135, 197, 106; 164/271, 137, 412; 29/402.15, 402.14, 402.09

[56] References Cited

U.S. PATENT DOCUMENTS

| | | | |
|---|---|---|---|
| 1,758,823 | 5/1930 | Blagé | 249/174 |

FOREIGN PATENT DOCUMENTS

| | | | |
|---|---|---|---|
| 230028 | 11/1963 | Austria | 249/174 |
| 1380726 | 1/1975 | United Kingdom | 249/174 |
| 253305 | 2/1970 | U.S.S.R. | 249/174 |
| 592514 | 4/1978 | U.S.S.R. | 249/135 |

*Primary Examiner*—Gus T. Hampilos
*Assistant Examiner*—J. Reed Batten, Jr.
*Attorney, Agent, or Firm*—Keil & Witherspoon

[57] ABSTRACT

This invention relates to an improved ingot mold. The only alteration in design involves the outside surface of the ingot mold. The invention involves recesses cast or cut into the outside surface of ingot molds for the specific purpose of accommodating steel reinforcement bands. These recesses allow air spaces to exist between the mold surface and the steel reinforcement bands for the purpose of reducing thermal conduction and to bridge any irregularities in the iron mold surface. They can further allow the band to be applied in such a way that the band does not extend beyond the furthest outside surface of the ingot mold exterior wall. The benefit of this is that the steel band is protected from any abuse that may occur as a result of handling the mold. The further benefit is achieved of protecting the band from molten steel that may splash from the top of the mold during teeming (pouring) or transportation. The band is set deeply enough into the mold surface that any molten steel will drip down the outside of the band rather than between the band and the mold wall.

3 Claims, 5 Drawing Figures

INGOT MOLD

This invention concerns a method for repairing and reinforcing cast iron molds, particularly steel works ingot molds, using continuous steel bands in which cracks in the mold wall are prevented from opening or enlarging by the elastic properties of the steel band. These elastic properties, the tensile strength of the band, are preserved by reducing heat conduction from the surface of the mold to the steel band.

More specifically, this invention relates to an improved ingot mold, the mold being cast or cut in such a way as to make provision for steel reinforcement bands and to maximize the effectiveness of these bands.

Cast iron molds are subjected to extreme stresses due to thermal shock and moments created on the iron walls due to uneven expansion as a result of uneven heating. The temperature difference between the inside and outside of the mold can be as much as 2000° F. The resulting stress is frequently relieved by the cracking of the iron wall. Since cast iron is a material which can sustain very high forces in compression but very low forces in tension, the cracks appearing in the mold walls have a tendency to spread through repeated use. A means for counteracting the tendency of the cracks to spread is by bridging the cracks with a steel plate that is anchored to the mold wall, thus the forces that act to spread the crack are absorbed by the steel plate. The steel plate applied in such a way provides a ductile material that can resist tension and thus hold the crack together. It is known that an extended usable life of an ingot mold can be obtained when it is repaired in such a way.

A further known means of extending the usable life of ingot molds is to provide them with steel bands that completely surround the mold and are fitted tightly to the circumference of the ingot molds and anchored at prescribed points to the ingot mold wall. A known method involves conforming the steel bands exactly to the outside surface of the ingot mold wall and providing the band with a plurality of fastenings along its entire circumference. This means of placing the steel band in direct contact with the iron mold wall has some serious disadvantages.

The primary disadvantage of placing the steel band in contact with the iron mold wall is that thermal conduction from the iron mold wall to the steel band is maximized. Increased temperatures of the steel bands result in a lowering of their stress values, which increase the likelihood of plastic distortion of the steel band. This diminishes the effects of the steel bands whose sole purpose is to provide the iron mold with the ductility that the iron lacks.

An additional disadvantage of conforming the steel band to the outside surface of the iron mold wall is that excess band must be provided for indentations in the mold wall. The mold is thereby provided room for expansion as a result of the excess lengths of steel band.

Further disadvantages result from applying steel reinforcing bands directly to the outside surface of the ingot mold wall so that they extend beyond the surface plane of the mold wall. Firstly, ingot molds are frequently subjected to quite abusive treatment. A common means of extracting ingots that stick in a mold is to swing them back and forth from a crane so as to gain momentum and then to cause them to collide with a solid stationary object. This has the effect of sometimes breaking pieces off of the ingot molds as well as extracting the ingot. Further, just in the simple handling of ingot molds, since they are so heavy—between 5 and 50 tons—there exists the distinct possibility that the steel band could be torn merely by another mold being scraped against it.

Another problem with the steel band being the furthest outside surface of the mold is that molten steel can fall over it during pouring or transportation of full molds, producing protruding scrap and debris that cling to the steel band when the molten steel cools and solidifies.

it is an object of the present invention to allow a reinforcement or repair that will minimize heat transfer from the iron mold to the steel bands and also to provide a means for maximizing the effects of the band by eliminating excess lengths that allow the mold to expand unhindered.

Another object of the present invention is to provide an ingot mold design that will minimize heat transfer from the iron mold to the steel bands, to provide a means for maximizing the effects of the band by eliminating excess lengths that allow the mold to expand unhindered, and to protect the steel reinforcing bands from handling dangers and splashing molten steel. This objective is obtained by the present invention through the use of recesses which are located on the outside surface of the iron mold wall at prescribed locations. These recesses enable the steel band to be applied in such a way that it is elevated for prescribed distances from the surface of the iron mold wall while at the same time recessed into the iron mold wall. This results in an insulating air space between the iron mold wall and the steel band, so that the heat transfer to the steel band as a result of conduction is minimized.

By elevating the steel band from the iron mold wall the secondary advantage of bridging imperfections on the surface of the iron mold wall is achieved. Thus, no excessive counterproductive length of steel band is added to the band. The recesses may be of any reasonable dimension and different recesses on the same mold may vary in dimension according to necessity.

The recesses may be applied so that one long recess is set for the entire length of each side of the mold. They may also be cast or cut in such a way that there results ribs or a series of short recesses along each side. They can be cast or cut so that the corners are recessed with additional and deeper recesses cast or cut along each side. They may be cast or cut so that only the center of each side which becomes the hottest part of the ingot mold is recessed. The recesses may be cast or cut in such a way that they are not at the bottom of the mold, but at some point further up the mold surface. The recesses may be cast or cut at a point above the bottom of the mold so as to allow protuberances below the reinforcement band to protect the band from rough handling practices.

Explanation will hereafter be made with reference to the accompanying drawings.

Figure 1:
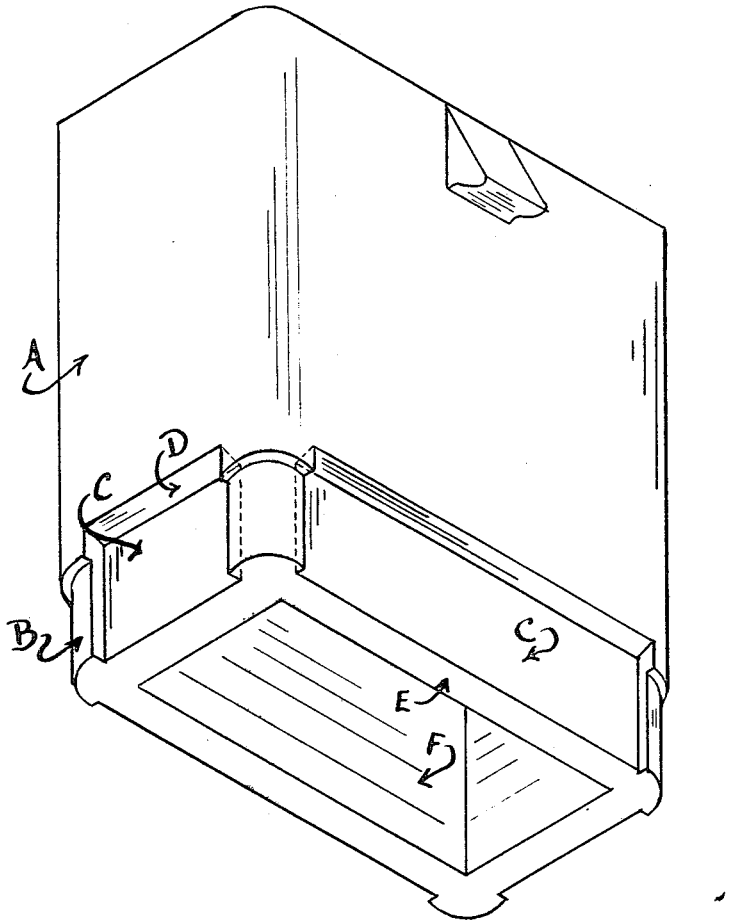
FIG. 1 is a perspective drawing of an ingot mold with recesses cast or cut into the outside surface of the mold walls.

In FIG. 1 an ingot mold is shown with two types of recesses cast or cut into the outside surface of the ingot mold qall (A). The primary recess (B) is cast or cut into the mold so that a steel reinforcing band can be applied in such a way that it is recessed below the outside surface of the mold wall (A). This has the effect of protecting the reinforcing band from abusive handling practices. A secondary set of recesses (C) are cast or cut into the mold wall for the purpose of allowing the reinforcing band to be elevated from the surface of the mold wall and so bridge any irregularities on the mold surface and also reduce thermal conduction from the mold to the reinforcing band. The secondary recesses (C) extend further up the mold wall at D than the primary recesses (B) so that air can easily pass behind the steel band through convection currents, and so aid in cooling the steel band and the mold.

Figure 2:
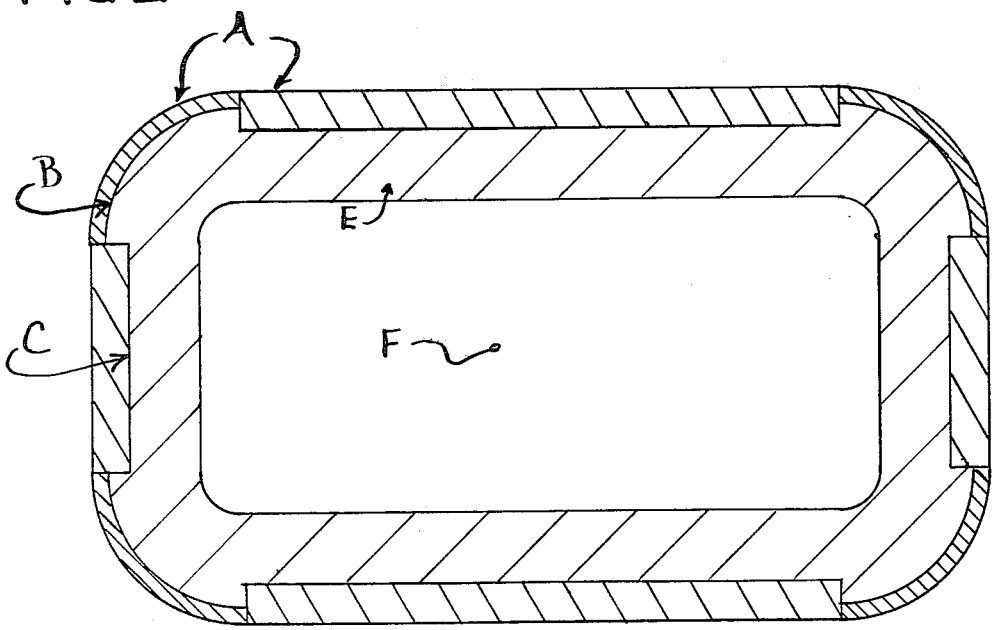
FIG. 2 is a bottom elevation drawing of an ingot mold with recesses cast or cut into the outside surface of the mold wall.

FIG. 2 shows the bottom elevation of the mold with the recesses cast or cut into the mold exterior walls. In FIG. 2, (E) is the bottom surface of the ingot mold, and (F) is the casting space wherein the molten steel is poured to form an ingot.

Figure 3:
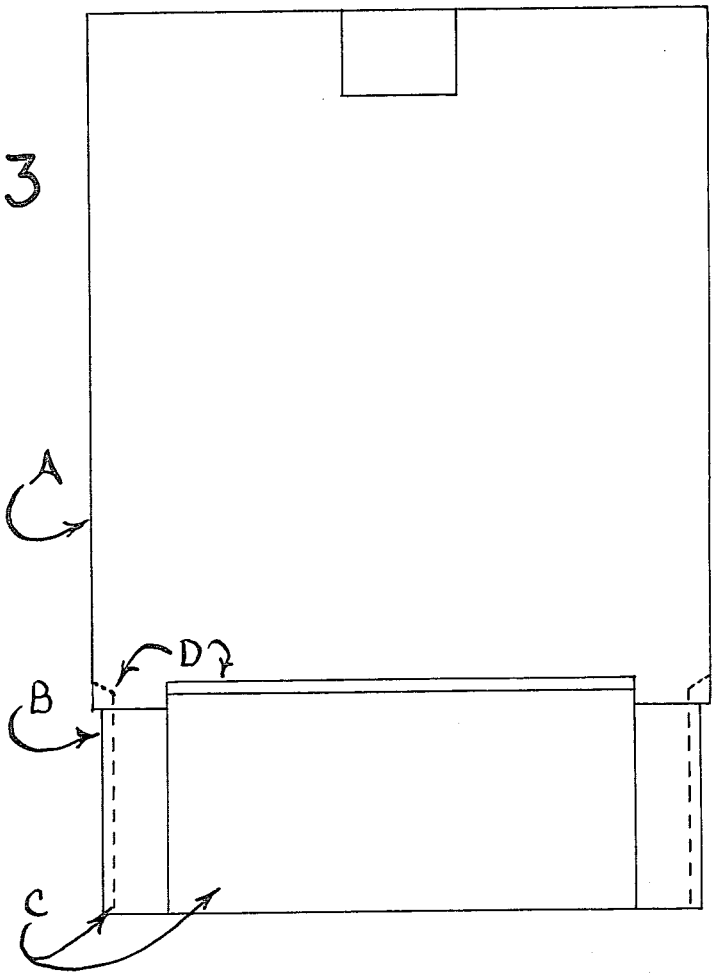
FIG. 3 is a front elevation drawing of an ingot mold with recesses cast or cut into the outside surface of the mold wall.

FIG. 3 is a front elevation drawing showing the relative configurations of the primary and secondary recesses. This drawing demonstrates clearly how the secondary recess (C) extends further up the mold wall at (D) than the primary recess (B).

Figure 4:
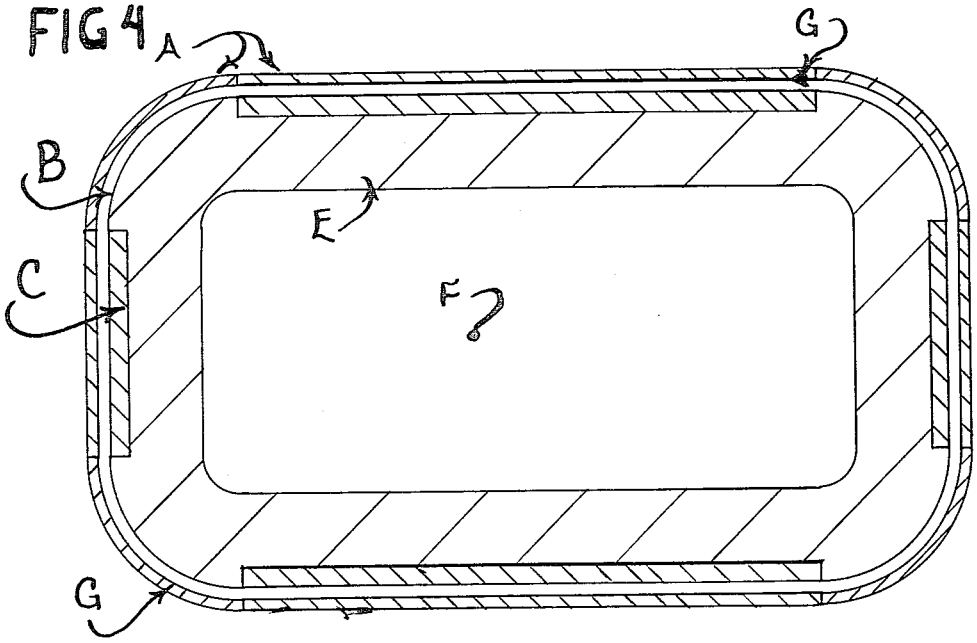
FIG. 4 is a bottom elevation drawing of an ingot mold with recesses cast or cut into the outside surface of the mold wall and with a steel reinforcement band in place.

FIG. 4 is a bottom elevation of an ingot mold with a steel reinforcement band (G) in place. The reinforcement band (G) is recessed into the mold wall (A) by the primary recesses (B). The steel reinforcement band bridges the secondary recess (C) and so avoids contact with the mold wall everywhere that secondary recesses are cast or cut, thus avoiding heat transfer through conduction.

Figure 5:
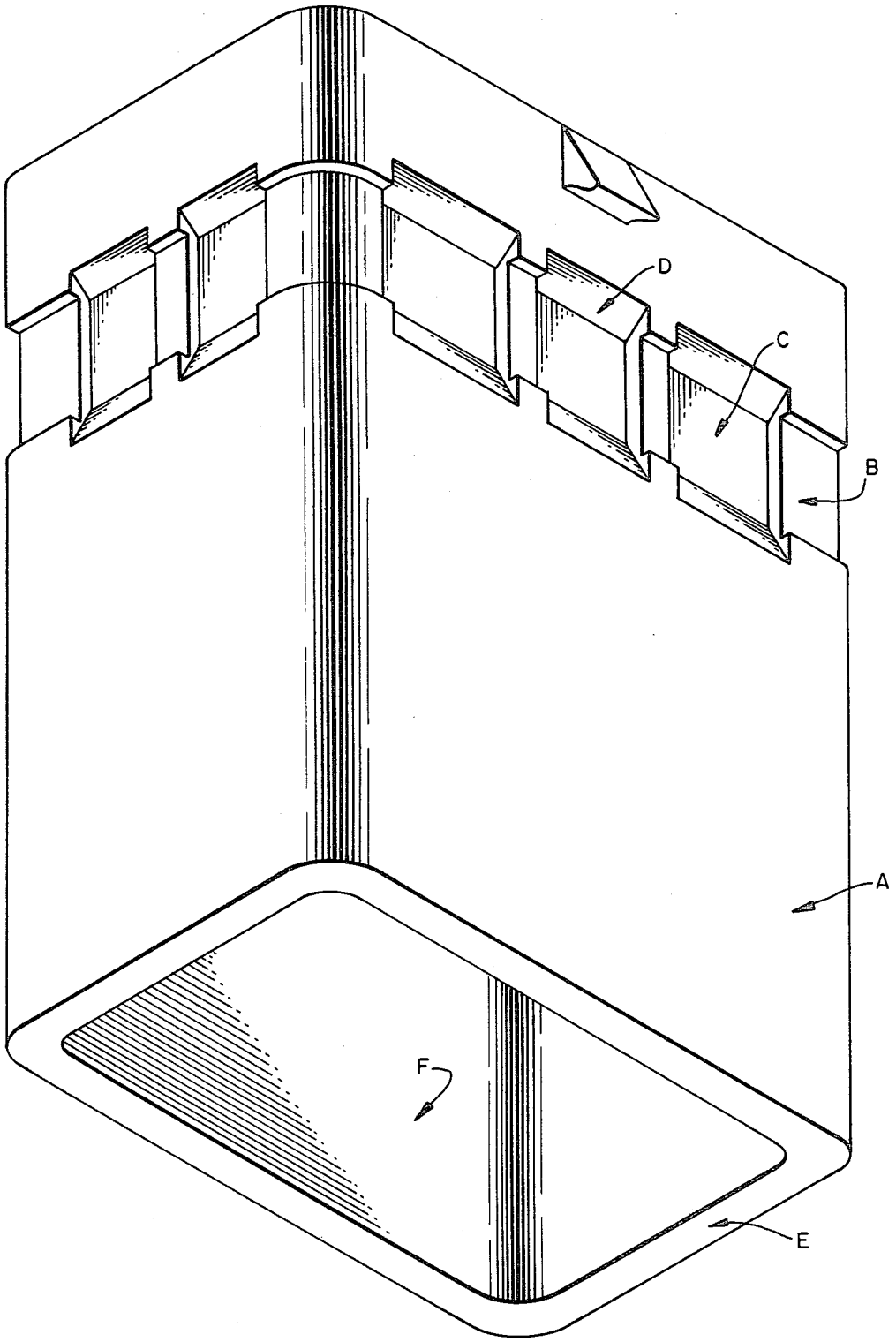
FIG. 5 is a perspective drawing of an ingot mold with recesses cast or cut into the outside surface of the mold walls and at least one mold face having a plurality of recesses defined therein.

In FIG. 5 an ingot mold is shown having a plurality of recesses (C) cast or cut into one mold face of the ingot mold wall (A).

This invention is not limited to the design as described in references to the drawings. The invention also is not restricted to any preceding descriptions as brought forth in the specification. This invention extends to any variations within the claims that are possible to be produced by persons skilled in the art.

What is claimed is:

1. An improved ingot mold, having vertical faces with vertical corner edges there between, and a reinforcing band placed around the mold over the vertical forces and the vertical corner edges; the improvement which comprises:

each face of said mold having at least one vertical recess defined therein, each recess being at approximately the same latitude and of a height greater than the width of the reinforcing band used to reinforce and repair said mold, each recess being separated from adjacent recesses by a less recessed portion defined in each vertical corner edge, said less recessed portion being located therein at approximately the same latitude as the recesses in the faces of said mold, each less recessed portion being of a depth at least as great as the thickness of the reinforcing band, and of a height at least as great as the width of said reinforcing band;

the reinforcing band being placed around the mold over the face recesses and the less recessed portions, contacting the mold only at the less recessed portions, thereby reducing heat conduction to said reinforcing band, said reinforcing band not protruding outward beyond the vertical corner edges of the mold, thereby protecting said band from damage should the corner edges of said mold contact another object.

2. An improved ingot mold as recited in claim 1, wherein said recesses extend upward from the bottom edge of the mold.

3. An improved ingot mold as recited in claim 1, wherein at least one mold face has a plurality of vertical recesses defined therein.

* * * * *